US007637308B2

(12) United States Patent
Hofer-Noser et al.

(10) Patent No.: US 7,637,308 B2
(45) Date of Patent: Dec. 29, 2009

(54) HEATING PLATE

(75) Inventors: Patrick Hofer-Noser, Bern (CH); Jürg Zahnd, Utzenstorf (CH); Christoph Boos, Bern (CH)

(73) Assignee: Swiss Sustainable Systems AG, Bern (CH)

( * ) Notice: Subject to any disclaimer, the term of this patent is extended or adjusted under 35 U.S.C. 154(b) by 340 days.

(21) Appl. No.: 10/940,449

(22) Filed: Sep. 14, 2004

(65) Prior Publication Data

US 2005/0121435 A1 Jun. 9, 2005

(30) Foreign Application Priority Data

Sep. 16, 2003 (EP) ..... 03405678

(51) Int. Cl.
*H05B 3/00* (2006.01)

(52) U.S. Cl. ..... 165/47; 165/64; 165/168; 392/465; 392/467; 392/482; 392/485; 392/486; 392/496; 219/213; 219/443.1; 219/463.1; 219/468.1

(58) Field of Classification Search ..... 165/47, 165/64, 168; 392/485, 486, 488, 491, 497, 392/465, 467, 482, 496; 122/19.1; 219/213, 219/443.1, 463.1, 468.1
See application file for complete search history.

(56) References Cited

U.S. PATENT DOCUMENTS

| | | | | | |
|---|---|---|---|---|---|
| 2,429,303 | A * | 10/1947 | Apatow | ..... | 219/542 |
| 2,554,745 | A * | 5/1951 | Kapsch | ..... | 392/497 |
| 2,583,761 | A * | 1/1952 | Axelson | ..... | 219/542 |
| 3,942,781 | A | 3/1976 | Gerber | | |
| 4,723,065 | A * | 2/1988 | Meyer | ..... | 219/205 |
| 5,438,642 | A * | 8/1995 | Posen | ..... | 392/485 |
| 6,043,455 | A * | 3/2000 | Kurita | ..... | 219/213 |
| 6,816,670 | B1 * | 11/2004 | Renau | ..... | 392/467 |
| 7,123,827 | B2 * | 10/2006 | Garver | ..... | 392/496 |

FOREIGN PATENT DOCUMENTS

| | | | |
|---|---|---|---|
| DE | 3531424 | A * | 4/1986 |
| DE | 29610952 | | 10/1996 |
| DE | 19651079 | | 6/1998 |
| DE | 19651088 | | 6/1998 |
| DE | 29811677 | | 9/1998 |
| DE | 10003042 | | 7/2001 |
| GB | 2317219 | A * | 3/1998 |
| JP | 10160249 | A * | 6/1998 |

* cited by examiner

*Primary Examiner*—John K Ford
(74) *Attorney, Agent, or Firm*—Collard & Roe, P.C.

(57) ABSTRACT

The heating plate (1) has cavities (2), in which electrically heatable heating bodies (3) are disposed. A heat exchange medium circulated by a pump (4) transmits the heat emitted by the heating bodies (3). The heating plate is designed to obtain a uniform temperature distribution using as low a volume of heat exchange medium as possible. To this end, the cavities (2) are elongate and the heating bodies (3) are bar-shaped.

6 Claims, 2 Drawing Sheets

HEATING PLATE

CROSS REFERENCE TO RELATED APPLICATIONS

Applicants claim priority under 35 U.S.C. §119 of EUROPEAN Patent Application No. 03 405 678.8 filed on Sep. 16, 2003.

BACKGROUND OF THE INVENTION

1. Field of the invention

The invention relates to a heating plate with cavities, in which electrically heatable heating bodies and a heat exchange medium are disposed in order to transmit heat emitted by the heating bodies to the plate, in which the cavities are fitted with connecting means to permit circulation by the heat exchange medium.

2. The Prior Art

Such heating plates are used in laminating devices, in particular, as a means of producing photovoltaic modules or alternatively for producing plates joined by thermal adhesives or thermoplastic materials. In applications of this type, it is very important to obtain a uniform temperature across the entire surface of the heating plate, because even slight temperature differences can lead to faulty products.

A first type of known heating plates has integrated heating elements, which impart heat to the plate by heat conduction. This being the case, the temperature distribution along the heating elements can not be controlled. Furthermore, the heating elements have to fit in matching orifices of the plate as exactly as possible to guarantee efficient heat transmission. However, this can lead to tension due to heat expansion. Contact corrosion can occur if the heating plate and the heating elements are made from different materials. If heat-conducting pastes are used in order to improve heat transmission, these can dry out over time which in turn means that temperature differences can occur across the surface of the heating plate.

In a second type of known heating plates, cavities are provided, through which a heat exchange medium such as oil, for example, is circulated, and the heat exchange medium is heated externally to the heating plate. The heat exchange medium naturally cools as it flows through the cavities, which alone can lead to undesirable temperature differences at the surface of the heating plate.

A heating plate is known from German utility model DE 296 10 952 U1, in which electric heating elements are disposed in cavities of the heating plate and the cavities contain a circulating heat exchange medium. Since the cavities in this heating plate are separated by supporting walls with orifices for the heat exchange medium, these cavities are relatively large and a correspondingly large amount of heat exchange medium is needed. The orifices cause undesirable flow losses, which lead to a high drop in pressure. As a result of the orifices, the flow in the cavities is difficult to control and regions occur in which virtually no heat exchange medium flows. This can cause local cooling of the heat exchange medium or local over-heating in the region of the heating elements, which in turn leads to undesirable temperature differences at the surface of the heating plate. If oil is used as the heat exchange medium, it can become "baked" on the heating elements due to over-heating, which impairs the exchange of heat.

SUMMARY OF THE INVENTION

Against the background of the prior art, the objective of the invention is to propose a heating plate, by means of which the disadvantages of the prior art outlined above can be avoided. In particular, one objective of the invention is to propose a heating plate which requires only a relatively small volume of heat exchange medium and in which the flow conditions of the heat exchange medium are more efficient than is the case with heating plates known from the prior art.

This objective is achieved by the invention due to the fact that the cavities are elongate and the heating elements are bar-shaped. By "elongate" in this connection is meant that the ratio of the internal width to the length of the cavities is at least one to ten.

This solution proposed by the invention permits the use of relatively long heating elements, which may be from one to six metres in length, in which case the ratio of the diameter of the cavity to heating element may be selected so as to permit operation with a minimum of heat exchange medium. This results in short reaction times throughout the entire system, in particular during heating and cooling. The difference between the inlet and outlet temperature is very slight due to the nature of the invention, because the heat source and heat sink are in the same place and the temperature along the heating element is balanced due to the fact that the heat exchange medium flows sufficiently rapidly.

In one particular embodiment of the invention, the cavities have a circular cross section. This means that they can be produced by boring. Naturally, the cavities may also be provided in the form of inserted tube elements. The heating bodies may be provided with spacers, which rules out any direct contact of the heating bodies with the internal walls of the cavities. The heating bodies may also have a non-circular cross section and may be twisted, thereby promoting a turbulent flow of the heat exchange medium. The cavities are preferably disposed parallel with one another, making it especially easy to obtain a uniform temperature distribution at the surface of the heating plate. Another means of promoting a uniform temperature distribution is to link the cavities to one another in a serial connection or in a parallel connection by connecting means. In certain cases, for example if very large surfaces have to be heated, it may be of advantage to use a combination whereby the cavities are connected in series and in parallel. This being the case, the cavities can be interconnected by the connecting means so that the cavities in at least two groups of cavities are linked to one another in a serial connection and the groups of cavities are inter-connected in a parallel connection.

There are various conceivable methods of operating the heating plate proposed by the invention. For example, the heat exchange medium may be circulated through the cavities of the heating plate in a circuit or in an open system. In one particular method, the heat exchange medium is additionally heated before entering the heating plate in order to heat the system more rapidly. To ensure that a uniform temperature is already obtained at the surface of the heating plate during the heat-up phase, it is of advantage if the flow quantity and circulation rate of the heat exchange medium are controlled in such a way that it is hotter as it flows out of the plate than it was when it flowed into the plate during a steady heat-up phase. The heating plate proposed by the invention may also be cooled by delivering a cool heat exchange liquid through the cavities. This may be achieved either by cooling the heat exchange medium in an extreme heat exchanger or by delivering another, cool heat exchange medium through the cavities.

BRIEF DESCRIPTION OF THE DRAWINGS

Specific embodiments of the invention will be explained in more detail below with reference to the appended drawings. Of these.

DETAILED DESCRIPTION OF PREFERRED EMBODIMENTS

Figure 1:
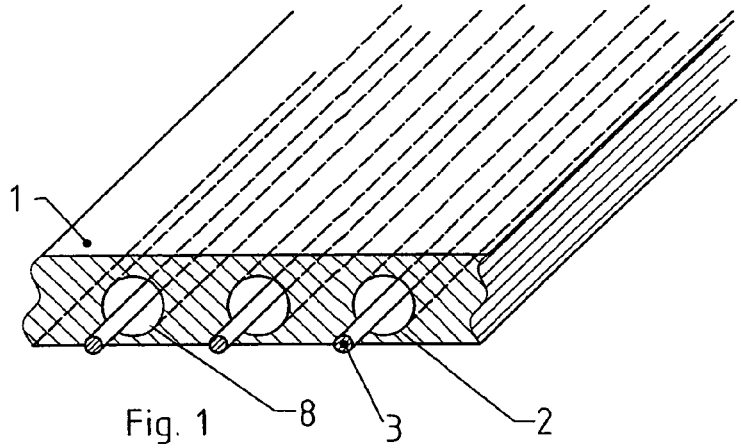
FIG. 1 is a schematic, cut-away view in perspective showing one embodiment of the heating plate proposed by the invention.

FIG. 1 is a schematic diagram showing a perspective end-on view, in section, of a heating plate 1, which may be made from metal, for example an aluminium alloy. Elongate cavities 2 are provided in the heating plate 1, which may be produced by boring, for example. Heating elements 3 are coaxially disposed in the cavities 2 in such a way that an annular gap 8 is left free between them and the internal walls of the cavities, the purpose of which is to permit circulation of a heat exchange medium. In one embodiment, the diameter of the cavities is 2 cm and their length 3.6 metres.

Figure 2:
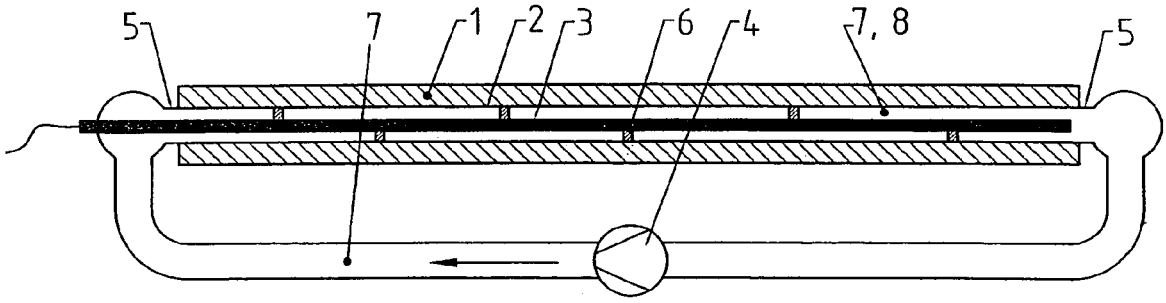
FIG. 2 is a schematic section through the embodiment illustrated in FIG. 1.
Figure 3A:
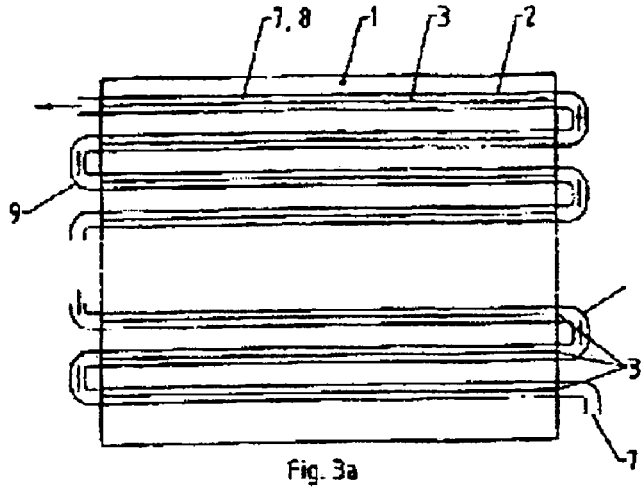
FIGS. 3*a* to 3*c* show three variants of the flow delivery through the heating plate proposed by the invention.
Figure 3B:
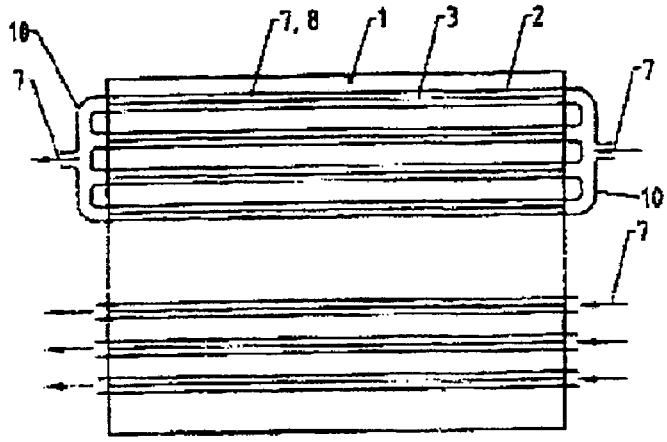

FIG. 2 provides a schematic illustration of the heating elements 3 in the heating plate 1 and the way in which the heat exchange medium is fed in and out of the heating plate 1. The inlet and outlet for the heat exchange medium are denoted by reference 5. To enable the heat exchange medium to circulate in a sealed arrangement, connecting means of a known type are provided on at least one end of the heating plate, which enable a heating element 3 or an electric feeder line for it to be inserted in a sealed arrangement. FIGS. 3*a* and 3*b* are schematic diagrams illustrating how such connecting means 9 and 10 might look in a plan view. The heat exchange medium is denoted by reference 7 and is delivered through the circuit by means of a pump 4. Instead of a pump, it would also be conceivable to use some other pressure-raising means. Spacers 6 are distributed around the external circumference of the heating element 3 to ensure that the heating element is not in direct contact with the internal wall of the cavity 2. Instead of or in addition to spacers, the heating elements 3 may have a non-circular cross section and may be twisted in order to generate a turbulent flow in the heat exchange medium and hence a good heat transmission.

Figure 3C:
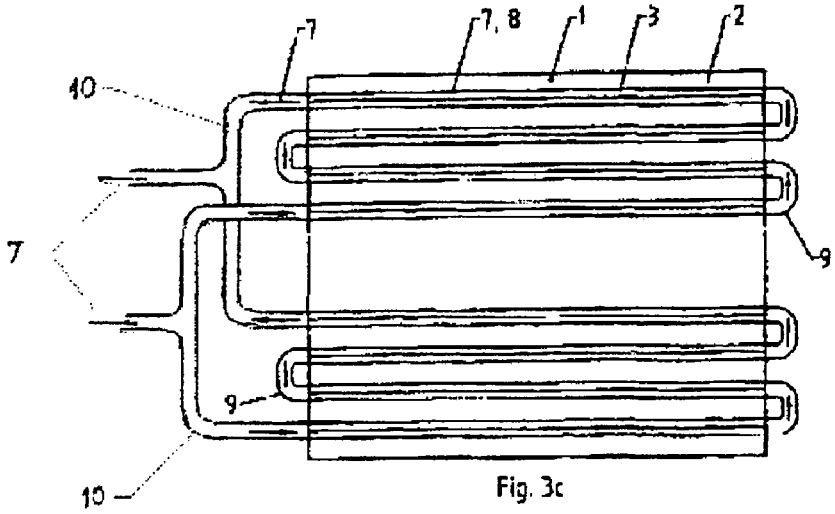

FIGS. 3*a*, 3*b* and 3*c* illustrate various ways in which a flow connection can be established between the individual cavities. In FIG. 3*a*, the mutually parallel cavities 2 are linked to one another by arcuate connecting parts 9 so that heat exchange medium circulates through them one after the other, in other words in series. FIG. 3*b* illustrates an arrangement in which the mutually parallel cavities 2 are grouped by means of connecting parts 10 so that the heat exchange medium flows through them in parallel. FIG. 3*c* illustrates an arrangement whereby groups of cavities 2 are connected in series and the groups are inter-connected in parallel.

What is claimed is:

1. A heating plate comprising a heating plate body having a heating plate surface, a plurality of elongate cavities passing through the heating plate body underneath the heating plate surface and substantially parallel thereto, electrically heatable rod-shaped heating bodies disposed in the cavities, spacers holding the rod-shaped heating bodies in the cavities out of contact with the wall of the cavities, a heat exchange medium disposed in the cavities for transmitting heat emitted by the heating bodies to the heating plate surface to obtain a uniform temperature across the entire heating plate surface, and connecting means fitted to the cavities to permit circulation of the heat exchange medium through the cavities;

wherein the connecting means comprises an inlet for the heat exchange medium, an outlet for the heat exchange medium, and a pump in fluid communication with the inlet and the outlet for recirculating the heat exchange medium in a continuous circuit through the cavities;

wherein the cavities have an internal width and length, the ratio of the internal width to the length being at least one to ten;

wherein the ratio of the cavity diameter of each cavity to heating body diameter of each heating body is such as to permit operation with a minimum of heat exchange medium.

2. Heating plate as claimed in claim 1, wherein the heating bodies have a non-circular cross section and are twisted.

3. Heating plate as claimed in claim 1, wherein the cavities extend parallel to each other.

4. Heating plate as claimed in claim 1, wherein the cavities are linked to one another in a serial connection by the connecting means.

5. Heating plate as claimed in claim 1, wherein the cavities are linked to one another in a parallel connection by the connecting means.

6. Heating plate as claimed in claim 1, wherein the cavities are linked to one another by the connecting means so that the cavities in at least two groups of cavities are linked to one another in a serial connection and the groups of cavities are inter-connected in a parallel connection.

* * * * *

UNITED STATES PATENT AND TRADEMARK OFFICE

CERTIFICATE OF CORRECTION

PATENT NO. : 7,637,308 B2
APPLICATION NO. : 10/940449
DATED : December 29, 2009
INVENTOR(S) : Hofer-Noser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 950 days.

Signed and Sealed this

Ninth Day of November, 2010

David J. Kappos

David J. Kappos
*Director of the United States Patent and Trademark Office*